US005159993A

United States Patent [19]

St-Germain

[11] Patent Number: 5,159,993

[45] Date of Patent: Nov. 3, 1992

[54] SELF-RAISING WORK PLATFORM ASSEMBLY

[75] Inventor: André St-Germain, Sainte-Marthe-sur-le-Lac, Canada

[73] Assignee: Gestion des brevets Fraco limitée, Sainte-Thérèse, Canada

[21] Appl. No.: 775,908

[22] Filed: Oct. 15, 1991

[51] Int. Cl.[5] ..... E04G 1/20

[52] U.S. Cl. ..... 182/82; 182/146; 182/229

[58] Field of Search ..... 182/145, 146, 82, 63, 182/222, 229

[56] References Cited

U.S. PATENT DOCUMENTS

| | | | |
|---|---|---|---|
| 771,878 | 10/1904 | Laughlin | 182/145 |
| 866,078 | 9/1907 | Sims | 182/145 |
| 2,244,374 | 6/1941 | Riblet | 182/146 |
| 3,318,414 | 5/1967 | Meek | 182/146 |
| 4,262,773 | 4/1981 | Basham | 182/145 |
| 4,641,728 | 2/1987 | McCabe | 182/146 |
| 4,809,814 | 3/1989 | St-Germain | 182/146 |

*Primary Examiner*—Reinaldo P. Machado

*Attorney, Agent, or Firm*—Pierre Lespérance; François Martineau

[57] ABSTRACT

The self-raising work platform assembly includes a pair of spaced towers adapted to be erected alongside a building structure, sleeve members surrounding and guided along the respective towers, joists extending between and releasably hooked to the sleeves, a flooring supported by the joists and chain blocks carried by the sleeves. The chains can be hooked to the tower to raise the sleeves, the joists and the flooring, to the level at which work on the building is to be effected.

20 Claims, 8 Drawing Sheets

SELF-RAISING WORK PLATFORM ASSEMBLY

FIELD OF THE INVENTION

The present invention relates to self-raising work platforms which can be raised along a building structure, so that workmen can effect work on the latter.

BACKGROUND OF THE INVENTION

U.S. Pat. No. 4,809,814 dated Mar. 7, 1989, entitled: SCAFFOLDING, inventor Jean St-Germain, describes a scaffolding including a pair of towers each made of tower sections adapted to be secured in end-to-end relation, a work platform completely surrounding said towers and hydraulically-operated hooks extendable and retractable along the towers and selectively engaging steps of said towers to raise the platform along the towers. Although the work platform assembly in accordance with the above-noted invention has been found to be a great improvement over conventional manually-erected scaffoldings, certain inconveniences have been found in practice, such as the need to climb down the platform onto a suspended swing stage for the installation of cross-braces interconnecting the towers and of anchors to secure the towers to the building wall, these operations being effected every time the platform is raised a certain amount. The removal of the braces and of the anchors needs also to be effected in the same manner every time the platform is lowered.

A further disadvantage of the scaffolding of this prior patent resides in the fact that several work platforms cannot be suspended at different levels from the main work platform due to the existence of the cross-braces, thereby restricting concurrently effected work at a single level, namely the platform level.

Another disadvantage of the above-noted system resides in the fact that the hydraulically-operated platform raising means is an expensive raising mechanism which also entails frequent maintenance due to the working environment in which it is located.

Another disadvantage of the system is that for each platform, two columns or towers are required, resulting in a time-consuming and expensive installation for a given platform length.

OBJECTS OF THE INVENTION

The general object of the present invention is the provision of a self-raising work platform assembly designed to overcome the above-noted disadvantages.

Another object of the invention is to provide a work platform assembly which is more flexible than the above-noted system, in that it has more applications; in that loads can be raised on the platform using a simple hoist, thereby eliminating the requirement for using a tower crane or the like; and in that it can be used for holding concrete mold forms to mold concrete walls or columns.

SUMMARY OF THE INVENTION

The work platform assembly of the invention comprises a pair of towers adapted to be horizontally, spacedly positioned adjacent a building structure, vertically-spaced anchor means fixed to each tower and adapted to be fixed to said building structure to maintain the towers upright, an elongated sleeve-like member surrounding and movable up and down each tower and having a longitudinally-extending slit opening at both ends of said sleeve to clear said anchor means; guiding means guiding the sleeves for up-and-down movement along the towers; lifting means interconnecting each tower and related sleeve to raise the sleeves and allow lowering by gravity of the sleeves along the towers; a first joist structure horizontally extending between and releasably hooked to said sleeves and flooring supported by the joist structure.

Preferably, a second joist structure is hooked to the sleeves and extend between the same horizontally above the first joist structure.

Preferably, a horizontally-extending rail is carried by the second joist structure, a trolley is movable along the rail and carries a hoist suspended therefrom and this hoist includes a hoisting cable which can raise a load through an aperture in the flooring of the first joist structure and deposit the same flooring.

Preferably, the lifting means includes a chain block having an input member adapted to be driven by a hand-held power rotary tool.

Preferably, each sleeve has two vertically-spaced shelves outwardly protruding from three sides of the sleeve and a walkway is mounted on said shelves.

Each joist structure preferably includes two joists hooked to the shelves at their ends, and the joists being laterally adjustable.

Preferably, the hooks of the joists engage the shelves with a play to allow limited longitudinal movement of the joists relative to the shelves to overcome any spacing variation in the installation of the towers.

Preferably, the towers are formed of tower sections releasably secured to each other in end-to-end relation.

Safety braking means are preferably provided for each sleeve, operable when the sleeves are accidentally lowered.

The two vertically-spaced joist structures also serve to hold a concrete molding form held by cantilever girders.

DETAILED DESCRIPTION OF PREFERRED EMBODIMENTS

Figure 1:
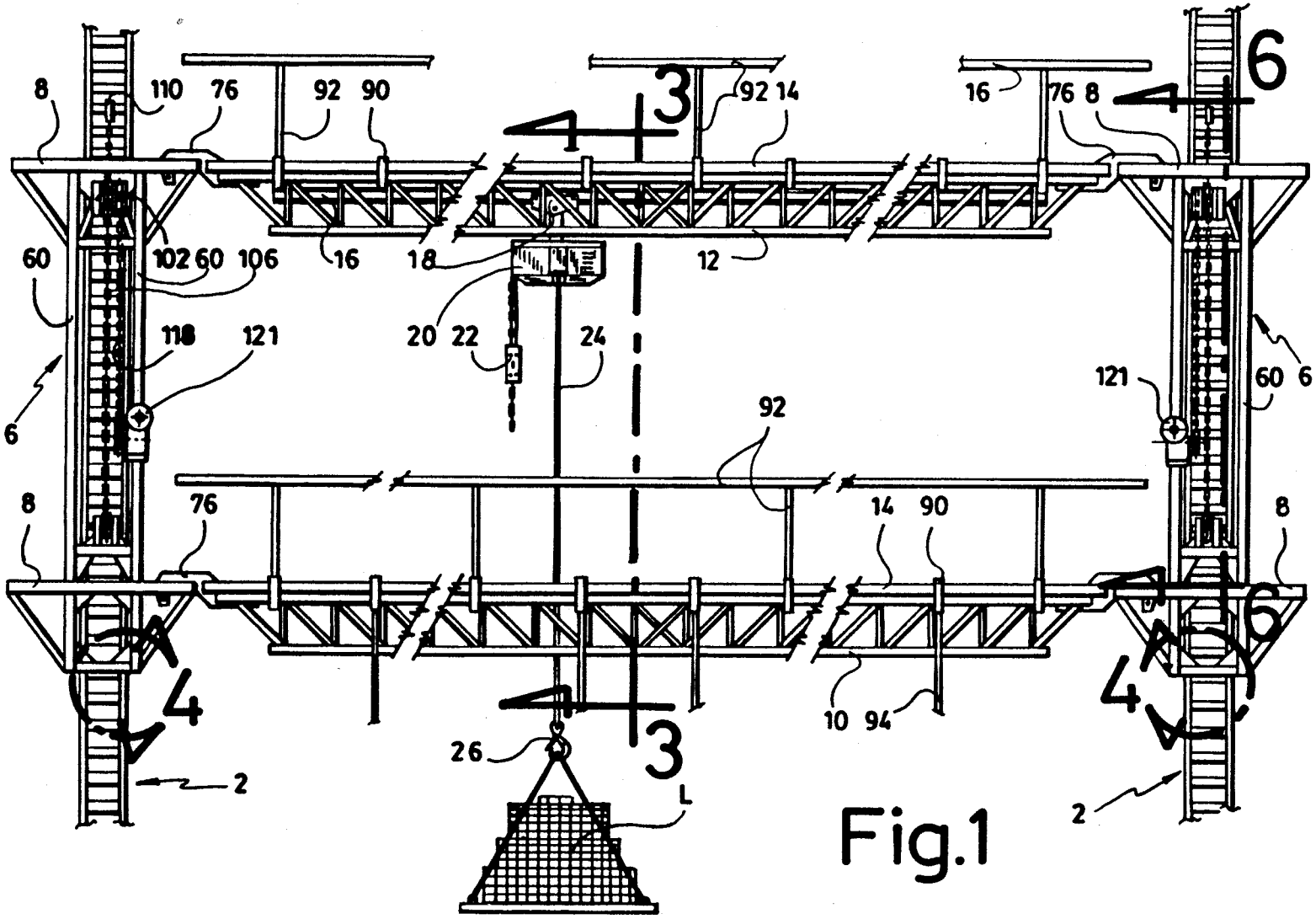
FIG. 1 is a partial elevation of the self-raising work platform assembly of the invention.
Figure 3:
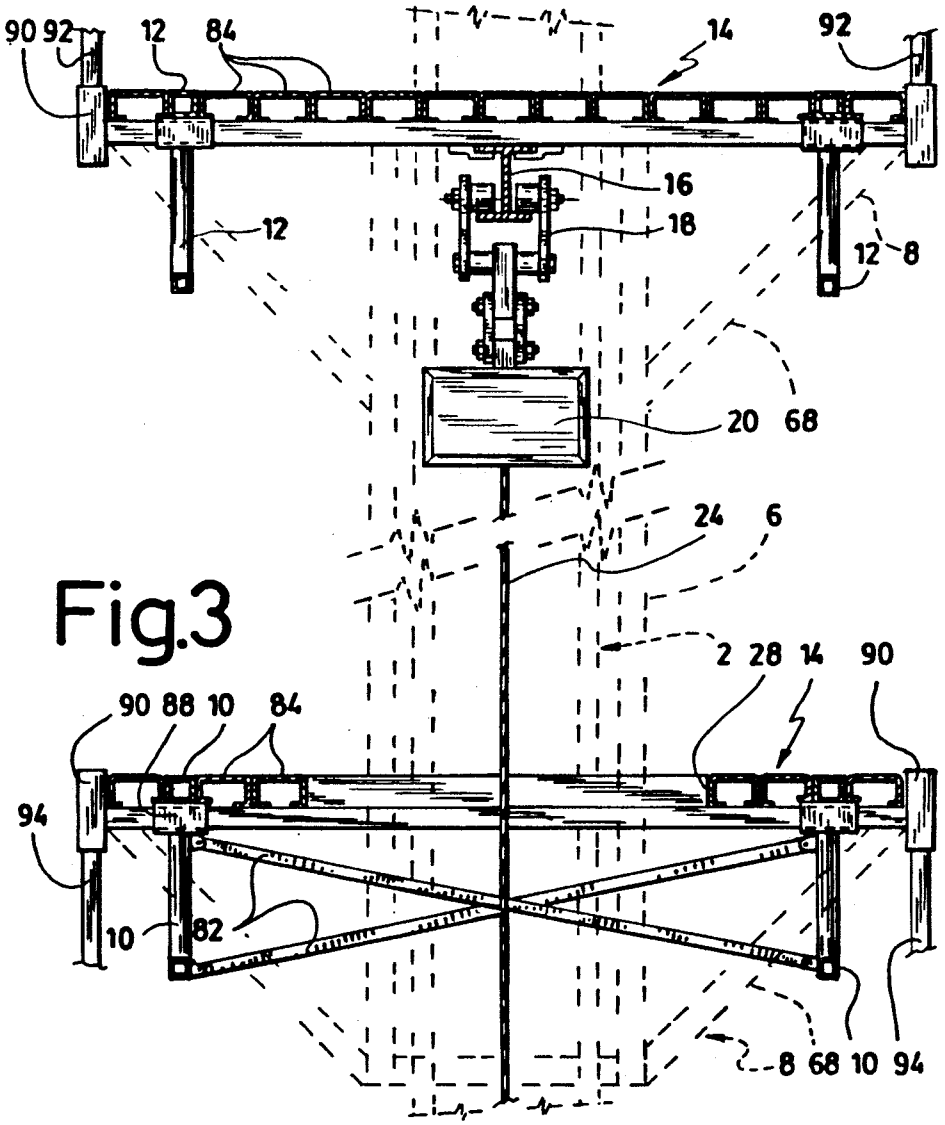
FIG. 3 is a cross-section taken along line 3—3 of FIG. 1.
Figure 2:
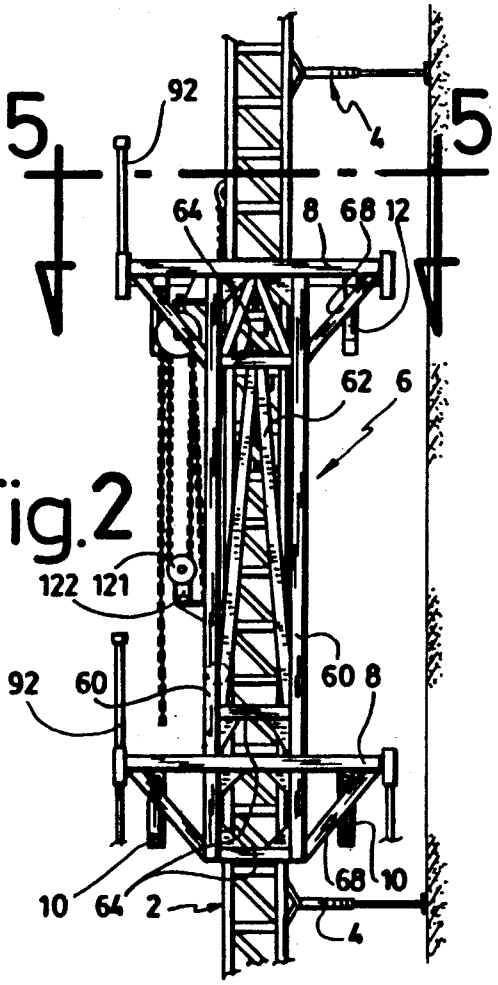
FIG. 2 is an end elevation of the assembly of FIG. 1.
Figure 14:
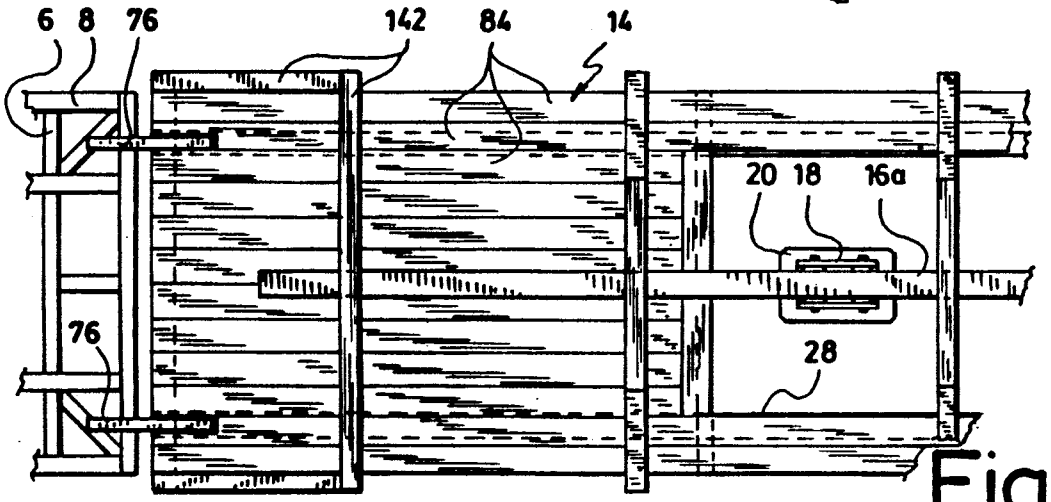
FIG. 14 is a top plan view of the embodiment of FIG. 13.

As shown in FIG. 1, the assembly of the invention comprises a pair of horizontally-spaced towers 2 resting on the ground adjacent a building structure B (see FIGS. 2, 5 and 10), being secured in upright position by vertically-spaced anchors 4. Each tower is surrounded by a sleeve 6 movable up and down and guided by the tower 2. Each sleeve 6 is provided at both ends with a shelf 8. A lower and an upper pair of joists 10 and 12, respectively, horizontally extend between and are removably hooked to the shelves 8, as shown in FIGS. 2 and 3. The joists of each pair are transversely spaced and support a flooring 14 for supporting workmen. A horizontally-extending rail 16 is supported by and between the upper pair of joists 12, and a trolley 18 is retained by and is displaceable along the rails 16. A hoist 20, preferably of the electrically-operated type controlled by a switch containing box 22, is suspended from the trolley 18 and comprises a hoisting cable 24 terminated by hook 26 for raising a load L through an opening 28 made in flooring 14 (see FIGS. 3 and 14). Thus, once the load is lifted through opening 28, the trolley 18 can be displaced and the load deposited on the flooring 14.

As shown in FIGS. 1, 2, and 16 to 19, each tower 2 is composed of tower sections 30 adapted to be secured together in end-to-end relation. Each tower section 30 is of generally quadrangular shape, preferably square shape, and composed of longitudinally-extending angle bars 32 at the four corners thereof interconnected by step-forming transverse bars 34 along two of the opposite sides and of transverse bars 36 and diagonal bars 38 on the other two opposite sides of the tower section. At each end of the tower section 30, bottom flat bars 40 and top angle bars 40*a* are provided with holes 42, through which bolts will extend to connect together with nuts the tower sections in end-to-end relation with the angle bars 32 in alignment.

Figure 5:
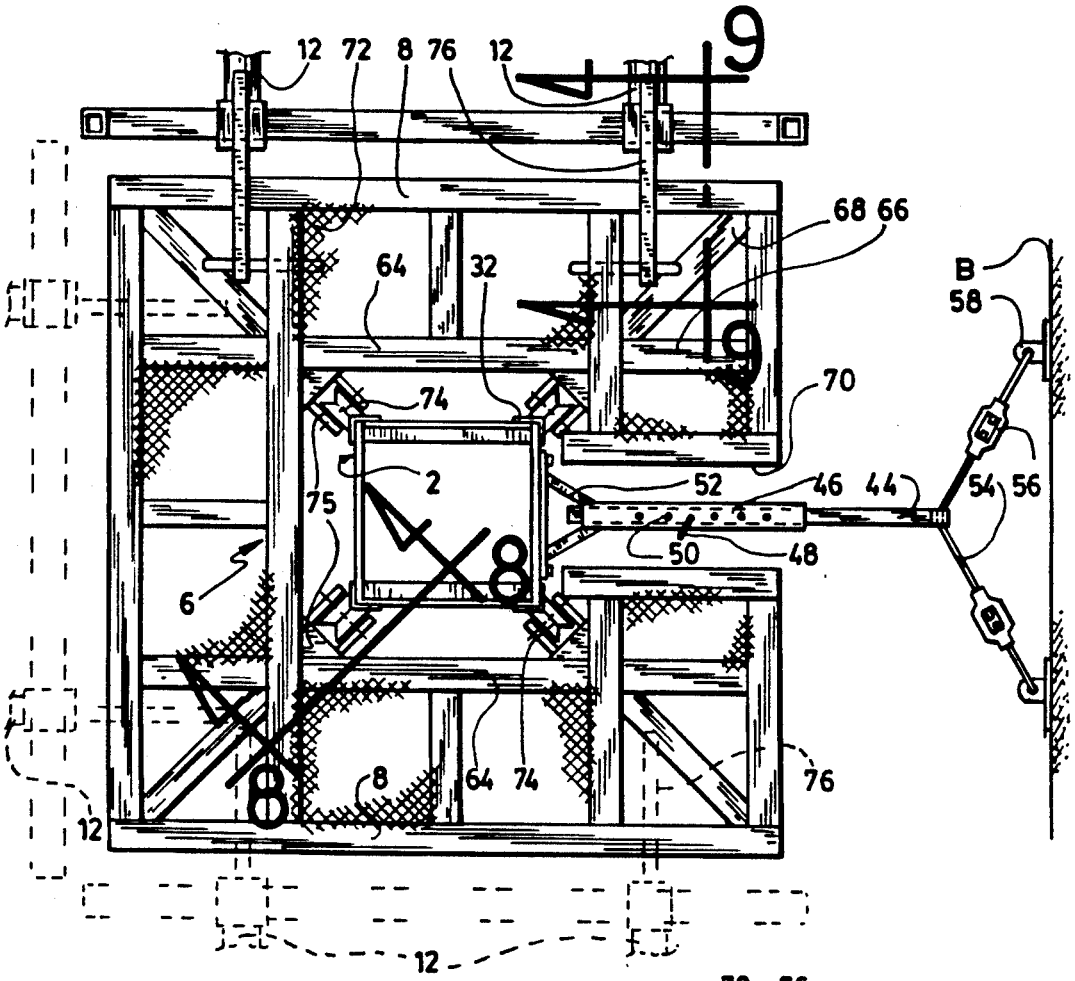
FIG. 5 is a plan section taken along line 5—5 of FIG. 2.

As shown in FIG. 5, each anchor 4 comprises a pair of telescopically-engaged tubes 44, 46 which can be adjusted by means of a pin 48 engaging any selected pair of registering holes 50 made in the tubes 44, 46. One end of outer tube 46 is removably secured by bracket 52 to one side of the tower 2, while the opposite end of the inner tube 44 carries a tensioning cable 54 fitted with turn-buckles 56 and attached to anchor plates 58 adapted to be removably secured to the building structure B. Anchors 14 thus adjustably stabilize the towers 2 against tilting towards or away from the building structure B.

Referring to FIGS. 2 and 5, each sleeve 6 is composed of longitudinal members 60, diagonal members 62 and transverse members 64 disposed around three sides of tower 2. The sleeve 6 is of generally U-shape construction and defines on the side of the tower provided with the anchors 4, a slit 66 for clearing said anchors when the sleeves move up or down of the tower. Each of the upper and lower shelves 8 is formed of framework including diagonal braces 68 and protrude from the three sides of the sleeve 6 and also from the fourth side of the sleeve, but leaving an opening 70 for the passage of the anchors 4. A walkway 72, in the for instance of a grille, is disposed on each shelf 8. Guiding rollers 74, provided with a V-shape groove, engage angle bars 32, being disposed about diagonals of the towers and mounted on brackets 76 fixed to the transverse members 64 at both ends of the sleeve 6.

Figure 9:
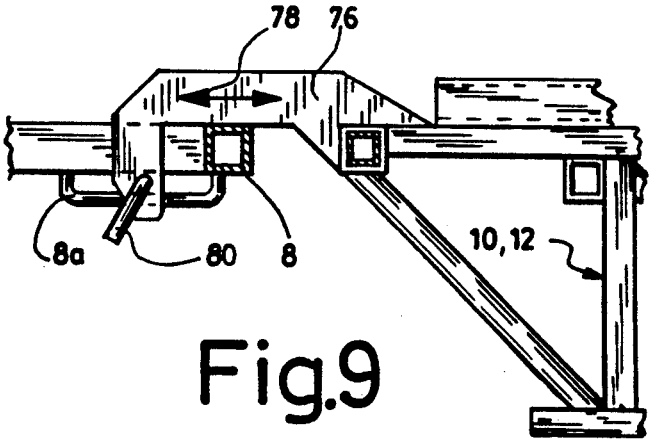
FIG. 9 is a partial vertical section taken along 9—9 of FIG. 5 and showing a hook at the end of a joist.
Figure 8:
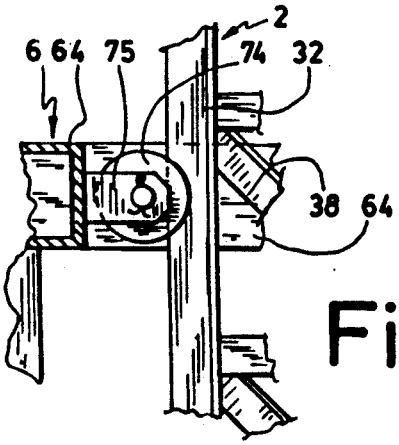
FIG. 8 is a partial side elevation, also in section, taken along line 8—8 of FIG. 5.
Figure 6:
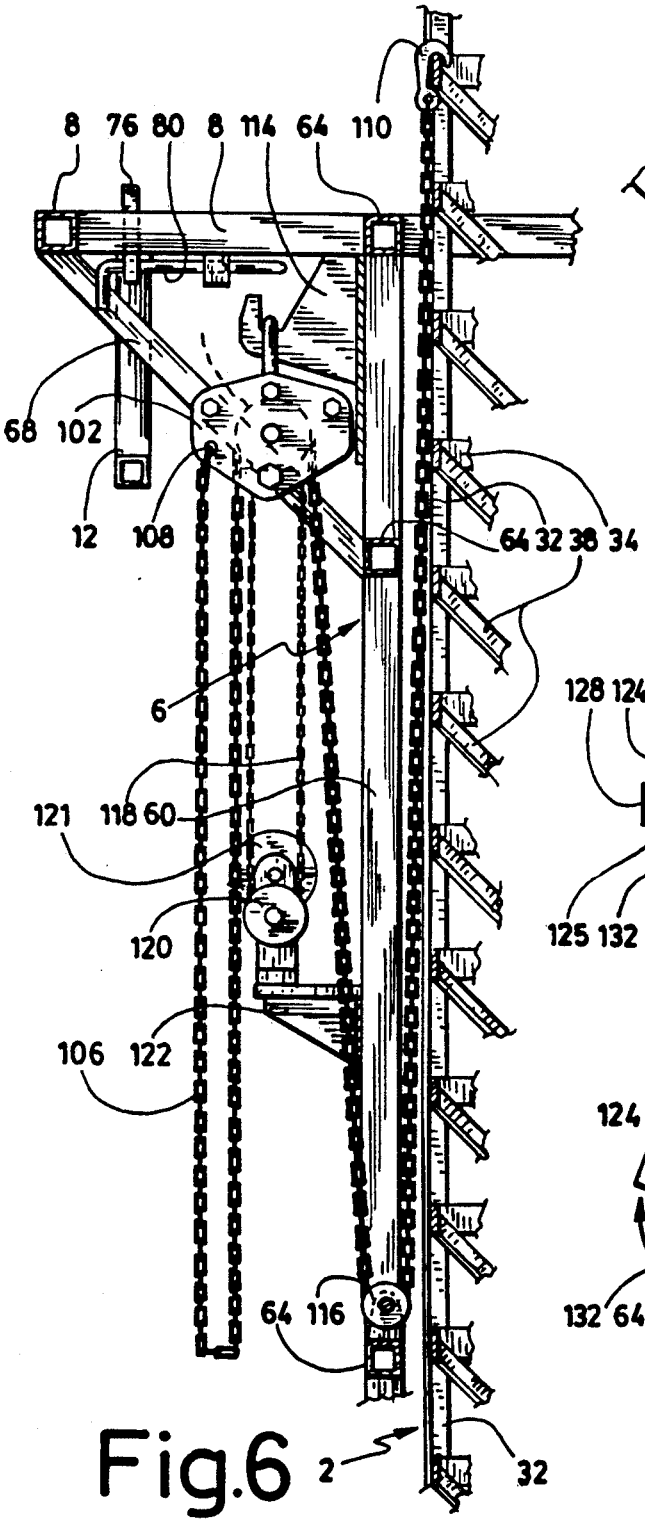
FIG. 6, seen on the third sheet of drawings, is a vertical section taken along line 6—6 of FIG. 1.

Each joist 10 or 12 forms a threstle work made of square tubing and both ends of each joist have a hook 76, as shown in FIGS. 5 and 9, which is downwardly turned and releasably engages shelf 8 with a longitudinal play, as indicated by the arrow 78, so as to take care of a certain variation in the spacing of the two towers. The outer end of each hook can be fitted with a safety pin 80, which extends through a loop 8*a* fixed to the underside of shelf 8. Pin 80 has to be removed to lift the joist out of engagement with the shelves 8. As shown in FIG. 5, a pair of joists 10 or 12 can be hooked onto any one of the free sides of the shelves 8 or at two or at three of said sides. Also, the spacing between the joists of each pair can be adjusted. Preferably, the joists of the lower pair are interconnected at suitable intervals by cross-braces 82, as shown in FIG. 3, to stabilize said joists.

Flooring 14 is preferably composed of channel members 84 disposed side by side and mounted on cross-members 86 inserted into square-shaped nipples 88 fixed to the top of the joists 10 and 12. Upright retaining nipples 90 can also be removably fixed to the ends of the cross-members 86 and serve to removably secure a handrail 92, as shown in FIGS. 1 and 2, and also to secure suspension members 94 to which another working platform can be secured, if so desired, at a lower level than the lower joists 10.

Figures 10, 11, 12:
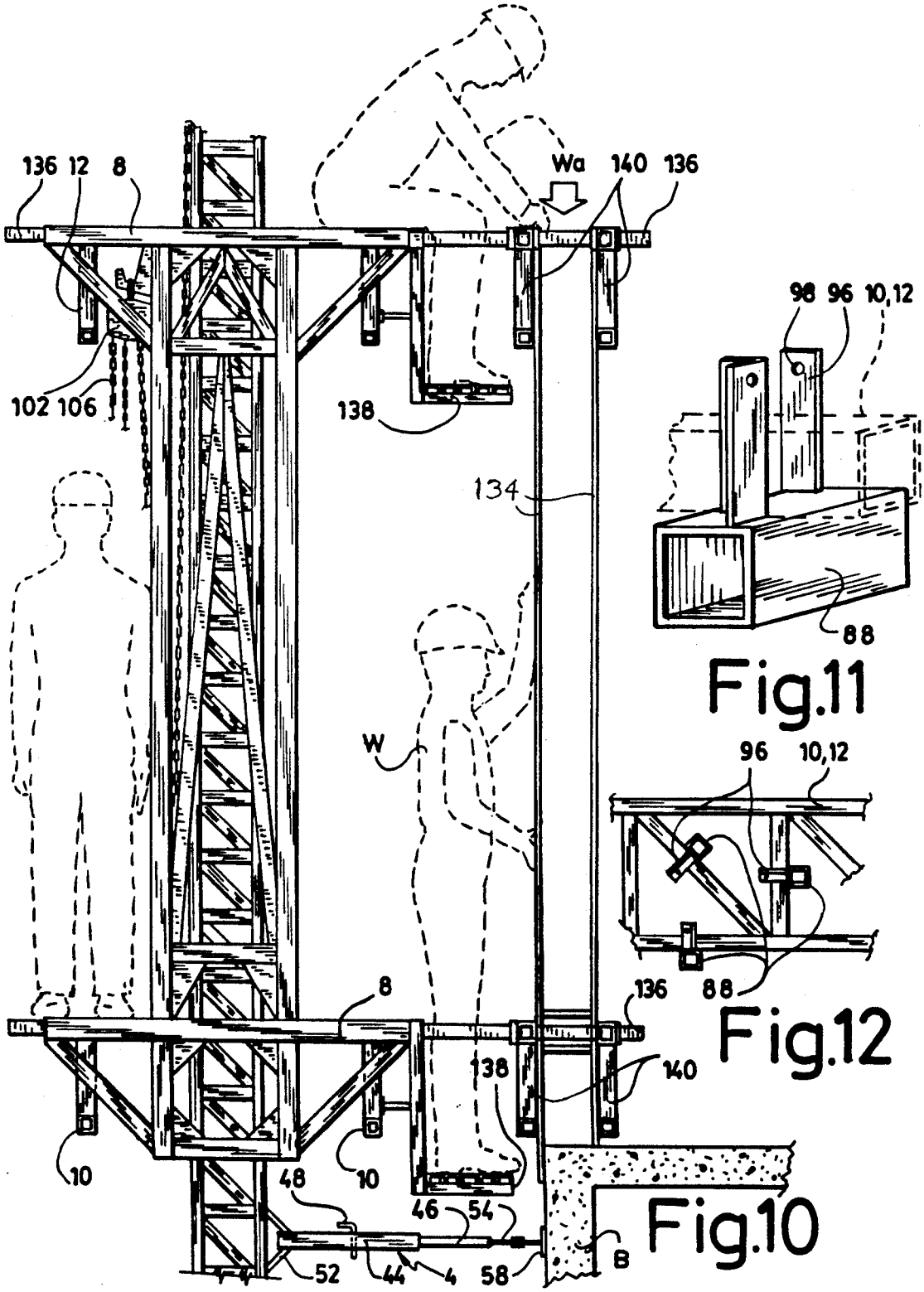
FIG. 10 is a side elevation of the work platform assembly as used to hold a concrete molding form in operative position.
FIG. 11 is a perspective view of a bracket for holding a cantilever girder.
FIG. 12 is a partial elevation of a joist showing the brackets of FIG. 11, in various installed positions.
Figure 18:
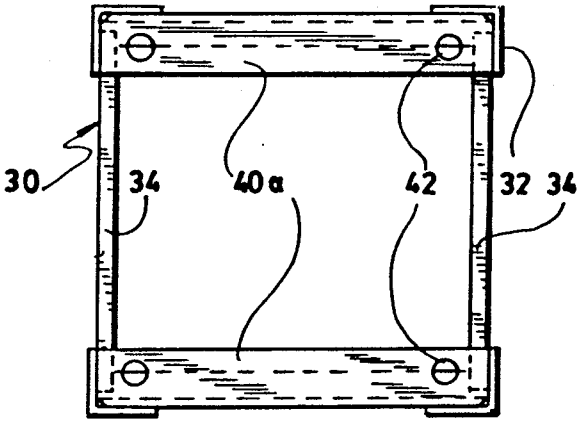
FIGS. 18 and 19 are end views taken along line 18 and 19, respectively, of FIG. 16.
Figure 19:
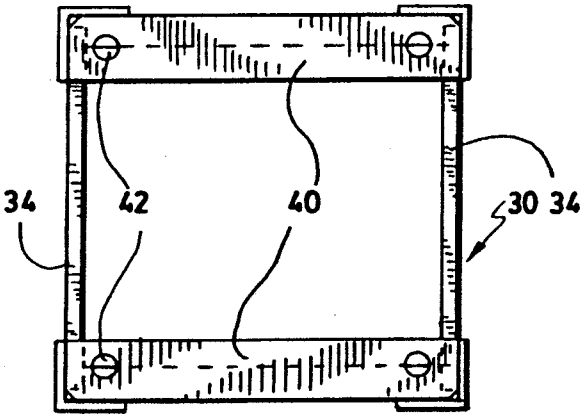
Figure 16:
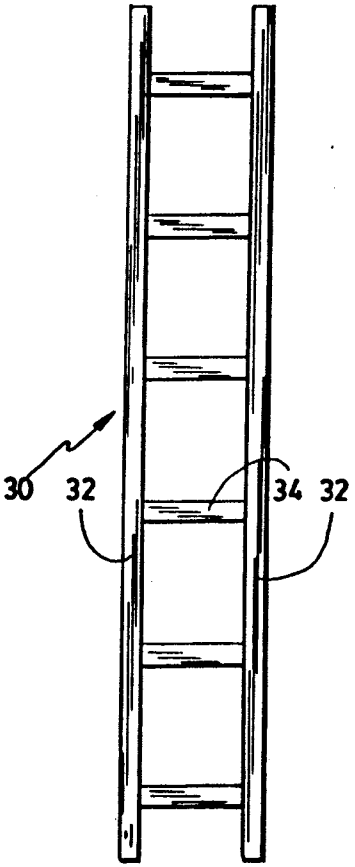
FIG. 16 is an elevation of one tower section.
Figure 17:
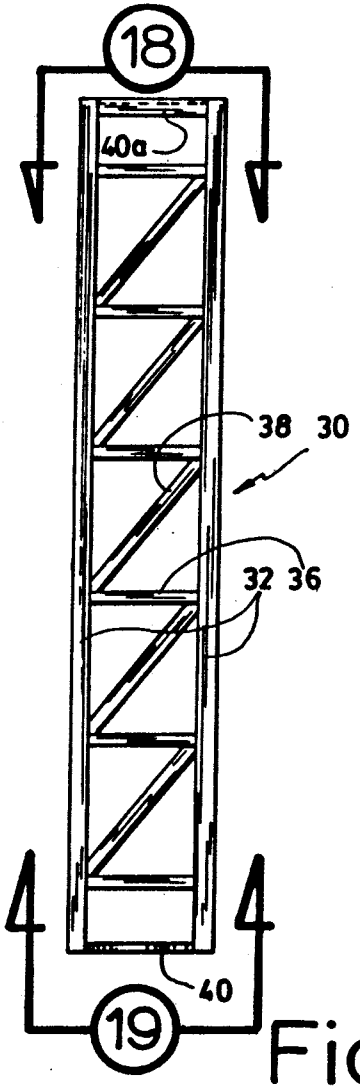
FIG. 17 is an elevation of the same tower section at right angles to that of FIG. 16.

As shown in FIGS. 11 and 12, the nipples 90 can be removably secured at any desired position along and at the desired level of the trestle work of the joist, as shown in FIG. 12, by means of attachment legs 96 fixed to the nipple 90 and provided with holes 98 at their outer end, through which a tensioning member can be attached to squeeze the part 100 of the joist 10 or 12 disposed between the two attachments 96.

As lifting means to raise the sleeves 6 and, consequently, the two working platforms along the towers 2, a chain block 102 is used for each tower. Each chain block 102 is of conventional construction. It comprises a pulley 104 having means for intermeshing with and driving a primary chain 106, one end of the latter may be conveniently secured to the chain block 102 at 108, and the opposite end being provided with a hook 110. The chain block 102 is preferably removably supported by a bracket 114 at the upper end of the sleeve 6; the primary chain 106 is trained around a pulley 116 carried by the sleeve 6 near the lower end thereof. The pulley 104 is mounted at the output end of a speed reducer included in the chain block 102, and the input end of said speed reducer is rotated by a secondary chain 118, the lower end of which is trained on an intermeshing pulley 120 carried by the output of an electric motor driven speed reducer 121 which is mounted on a support 122 fixed to the sleeve 6. If desired, the input of speed reducer 121 can be driven by a portable hand-held rotary tool with a tool bit inserted into an input hole of reducer 121. Obviously, the hook 110 can be attached to any selected step of the tower 2 above the sleeve. It is easy for a workman to climb up the tower along the steps to install hook 110. Each sleeve 6 can be raised on the tower alternately or simultaneously. In the first case, the lifting stroke has to be limited. In the second case, the lifting stroke depends on how high the hook 110 has been attached. Obviously, the motors driving the secondary chains 118 of two or several sleeves 6, could be controlled by a tele-control system. Other types of mechanical or electrical raising devices could be used, for instance a hoist 20.

The sleeves 2 are allowed to be lowered under gravity while rotating the pulleys 120 in the reverse direction.

Figure 4:
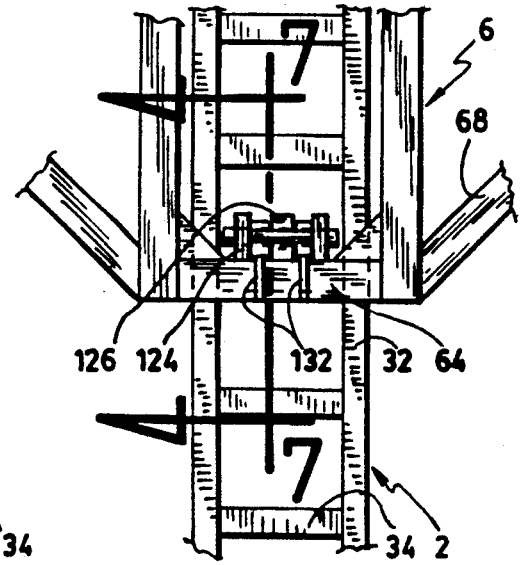
FIG. 4 is an enlarged elevation of the area delimited by circle 4 in FIG. 1.
Figure 7:
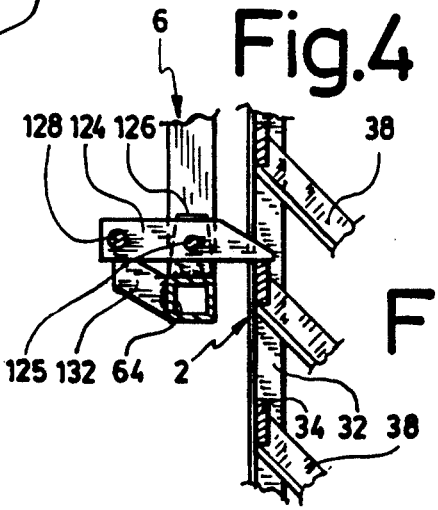
FIG. 7 and FIG. 7A are sections of the safety brake in two different positions, said sections being taken along line 7—7 of FIG. 4.
Figure 7A:
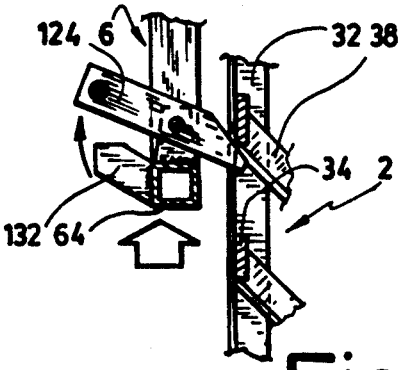
Figure 13:
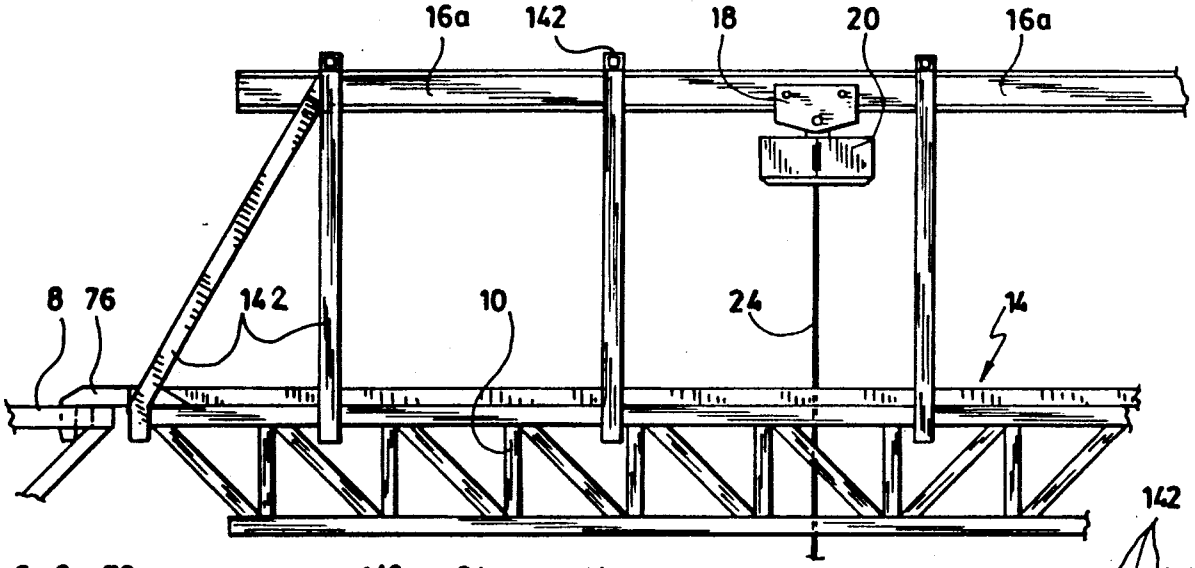
FIG. 13 is a side elevation of modified work platform with a hoist.
Figure 15:
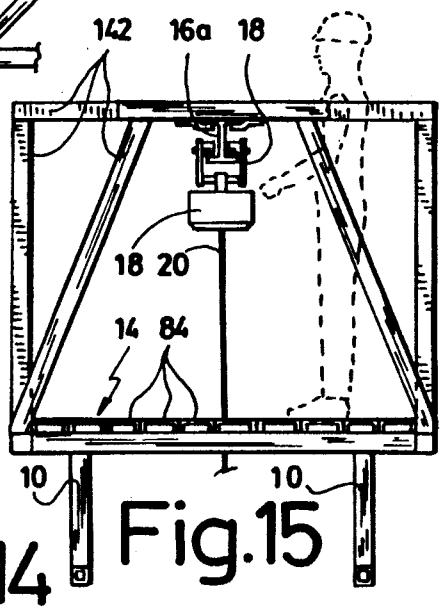
FIG. 15 is an end view of the embodiment of FIG. 13.

Referring to FIGS. 4, 7, and 7A, a safety system is provided to prevent accidental lowering of the sleeves 6. This system includes a pair of safety levers 124 pivoted intermediate their ends on a pivot 125 carried by an upstanding ear 126 fixed to the lower end of the sleeve 6. Levers 124 are interconnected by a handle 128. The inner bevelled 130 of the levers 124 are in the path of the transverse bars 34 of the tower 2. When the sleeve 6 is being raised, as shown in FIG. 7A, the safety levers 124 pivot to clear the bars 34. However, when the sleeve is lowered, the bevelled ends 130 abut against the top of bar 34 and stop downward movement of the sleeve, because the handle 128 abuts against brackets 132 outwardly protruding from the lower most bar 64 of the sleeve 6. To allow normal downward movement of the sleeve 6, the safety levers 124 must be kept upwardly pivoted to clear the tower bars 34.

Referring to FIG. 10, it is seen that the two shelves 8, together with the joists 10 and 12, can be used to support a concrete molding form 134 for molding a concrete column or a concrete wall on top of the already-erected part of the building structure B. Form 134 is maintained over the building structure B by means of cantilever girders 136 extending towards the building structure and telescopically engaged into the tubular members forming the outside of shelves 8 and/or in horizontal nipples 88 carried by the joists 10 and 12. FIG. 10 also shows lower level platform sections 138 carried by the joists 10, 12 and by the shelves 8 for the convenience of the lower workman W attending to the vertical positioning of the form 134 and of the upper workman WA attending to the pouring of concrete within the form. The two walls of the platform can be interconnected by tie-rods, not shown, in the usual manner and they are maintained in vertical position by means of additional joists 140 suspended from the cantilever girders 136 and disposed on each side of the walls of the form 134.

For certain applications, it may not be necessary to provide the upper platform consisting of the upper joists 12 and their flooring 14, and yet hoisting of loads onto the flooring 14 of the lower platform may be required, such loads, for instance, being bricks to be applied as facing on the building structure. In this case, a horizontal rail 16A is supported just above the lower platform by a framework 142. The rail 16 supports the hoist 20 by means of the trolley 18, as in the previous embodiment shown in FIG. 1, and the hoist cable 24 extends through an aperture 28 made in the flooring 14 to hoist loads through this aperture and to deposit the same on the flooring 14.

Figure 20:
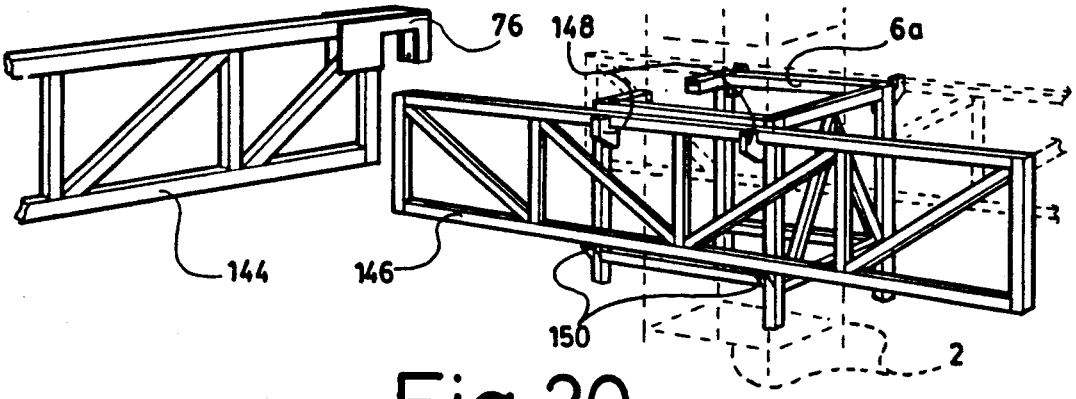
FIG. 20 is a partial perspective view of another embodiment of a sleeve and of a joist hooked to a transverse frame, in turn hooked to the sleeve.

FIG. 20 shows a modified arrangement of the system for hooking the joists to the sleeves 6. Slightly modified joists 144 are similar to the joists 10 and 12 and are used for the same purpose at the upper and lower levels of the platform assembly. Each end of joist 144 is provided with a hook 76 adapted to hook over a transversely-extending elongated frame 146, while allowing a longitudinal play of the joist 144 with respect to the sleeve 6, as in the previous embodiment. The frame 46 is directly hooked to the modified sleeve 6A by means of hooks 148 carried by the sleeve 6A, the latter being no longer provided with shelves 8. The lower portion of the frame 146 rests on support brackets 150, also directly carried by the sleeve 6A.

The two joists 144 can be adjustably laterally shifted towards or away from each other along the frame 146. In this case, hooks 148 and brackets 150 are carried by sleeve 6A on two opposite sides thereof, so that joist 144 can extend from two opposite sides of the sleeve.

Figure 21:
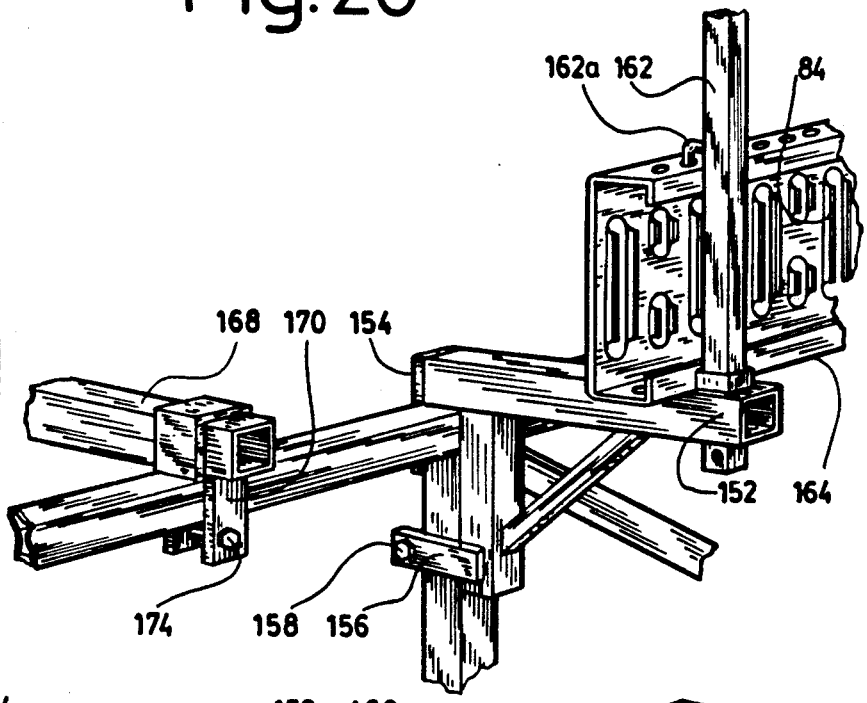
FIG. 21 is a partial perspective view of a joist and part of a modified hand-rail.
Figure 22:
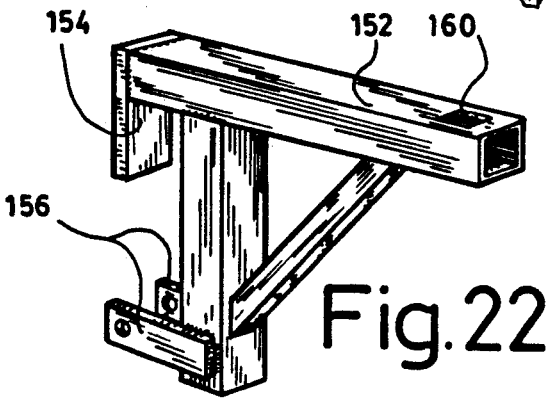
FIGS. 22 and 23 are perspective views of two elements illustrated in FIG. 21.
Figure 23:
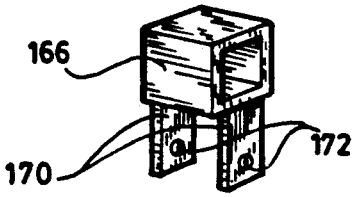

Referring to FIGS. 20 to 22, a modified hand-rail system is illustrated and can be used for both the upper and the lower platform. Right triangular supports 152 are secured at spaced intervals to the top member of the joist 144 by means of overlapping retainer plates 154 and 156, the latter interconnected by a transverse bolt 158. The outer end of the support 152 has a registering square hole 160 for receiving the lower end of the hand-rail post 162, the hand-rail being otherwise similar to the hand-rail 92, shown in FIG. 1.

Posts 162 are provided with a collar 164 resting on the top of support 152.

FIGS. 20 and 22 show nipples 166 similar to the nipples 88 and 90 and having the same function, for instance for securing to any part of the joist 144 transverse members 168 for supporting the flooring 14 or the like. Nipples 166 carry legs 170, having holes 172 for receiving a bolt 174 which serves, together with a nut, to tighten the legs 170 against a part of the joist 144.

FIG. 20 shows also that a flooring section 84 can be applied against the posts 162 to positively prevent articles, such as bricks and the like, from falling off the working platform. Flooring section is held in place by an L-shaped pin 162A fixed to post 162 and removably inserted into a hole made in the side flange of flooring section 84.

The self-raising platform assembly of the invention can be used to build the outside walls and columns of a building, and/or to apply insulation, brickwork, siding and the like to the outside walls of the building. Since the assembly can provide several levels of working platforms, different types of work can be concurrently effected on the building wall, such as pouring concrete walls, then applying insulation, then applying bricks or other external finish.

Since the joists 10 and 12 can extend from one, two or three sides of a tower, the number of required towers is decreased with respect to the above-noted patent and also different configurations may be used, depending on the shape of the building structure.

What I claim is:

1. A self-raising work platform assembly for buildings, comprising a pair of towers adapted to be horizontally spacedly positioned adjacent a building structure, vertically spaced anchor means fixed to each tower and adapted to be fixed to said adjacent building structure to maintain said towers upright, an elongated sleeve surrounding and movable up and down each tower and having a longitudinally-extending slit opening at both ends of said sleeve to clear said anchor means, guiding means guiding said sleeves for up-and-down movement along said towers, lifting means interconnecting each tower and related sleeve to raise said sleeves and allowing lowering by gravity of said sleeves along said towers, a first joist structure horizontally extending between and releasably hooked to said sleeves, and flooring supported by said joist structure.

2. A self-raising work platform assembly as defined in claim 1, further including a second joist structure horizontally extending between and releasably hooked to said sleeves above said first joist structure a vertical distance clearing a workman standing on the flooring of said first joist structure.

3. A self-raising work platform as defined in claim 2, further including a horizontal rail carried by said second joist structure, a trolley retained and movable along said rail, and a hoist suspended from said trolley and including a load hoisting cable, said flooring having an aperture through said cable can extend to hoist a load therethrough to be deposited on said flooring after movement of said trolley along said rail.

4. A self-raising work platform as defined in claim 1, wherein said lifting means includes a chain block including a chain with a hook to be removably secured to the tower and a chain driving pulley with a speed reducer secured to said sleeve-like member.

5. A self-raising work platform assembly as defined in claim 4, wherein said speed reducer has an input member adapted to be driven by a hand-held power-driven rotary tool.

6. A self-raising work platform assembly as defined in claim 2, wherein said towers are four-sided and said anchor means extends from one side only of said tower, and said sleeve has three sides overlying the three remaining sides of said tower.

7. A self raising work platform assembly as defined in claim 6, further including two vertically-spaced shelves outwardly protruding from said three sides of said sleeve and a walkway on said shelves.

8. A self-raising work platform assembly as defined in claim 6, wherein each of said first and second joist structures comprises a pair of horizontally-spaced joists which have end hooks which can be hooked to said sleeves on any one of said three sides of said sleeves, with a pair of joists protruding from any one of said three sides.

9. A self-raising work platform as defined in claim 7, wherein said hooks engage said sleeves with a play to allow limited longitudinal movement of said joists relative to said sleeves.

10. A self-raising work platform assembly as defined in claim 8, further including counter-braces transversely interconnecting each pair of joists.

11. A self-raising work platform assembly as defined in claim 2, wherein each tower is formed of tower sections releasably secured to each other in end-to-end relation.

12. A self-raising work platform assembly as defined in, claim 11, wherein each tower section is of quadrangular cross-section, with longitudinally-extending angle bars at each of the four corners thereof, each sleeve carrying near each end a set of four idle wheels with a V-groove engaging said angle bars, said wheels and angle bars forming said guiding means.

13. A self-raising work platform assembly as defined in claim 2, further including safety braking means carried by said sleeve and biased under gravity into a sleeve stopping position for engagement with said tower when said lifting means are not in operation.

14. A self-raising work platform assembly as defined in claim 2, further including a concrete molding form removably supported in vertical position by said first and second joist structures.

15. A self-raising work platform assembly as defined in claim 14, further including cantilever girders adjustably secured to said first and second joist structures, adapted to extend towards said building structure and holding said molding form on an erected part of said building structure.

16. A self-raising work platform assembly as defined in claim 7, further including cantilever girders extending tranversely of said joists, brackets having a tubular body telescopically receiving said girders, and attachment legs secured to said body and removably encircling and attached to a portion of said joists.

17. A self-raising work platform assembly as defined in claim 1, further including a horizontal rail carried by said first joist structure above the same, a trolley retained by and movable along said rail and a hoist suspended from said trolley and including a load-hoisting cable, said flooring having an aperture through which said cable extends to hoist a load therethrough to be deposited on said flooring after movement of said trolley along said rail.

18. A self-raising work platform assembly as defined in claim 1, wherein said anchor means each includes a pair of horizontally-disposed telescopically-engaged tubes, a bracket secured to one end of one of said tubes and removably attached to said tower, anchor plates adapted to be removably secured to said building structure and a cable attached to said anchor plates and to the opposite end of said second tube, said cable being provided with turn-buckle tighteners.

19. A self-raising work platform assembly as defined in claim 7, wherein each of said first and second joist structures comprises a pair of horizontally-spaced joists, which have end hooks releasably hooked directly to said shelves on any one of said three sides of said sleeves, with a pair of joists protruding from any one of said three sides.

20. A self-raising work platform assembly as defined in claim 6, wherein the two parallel sides included in said three sides of said sleeve are provided with hooks; and further including a transversely-extending frame removably supported by said hooks; and wherein each of said first and second joist structures comprises a pair of horizontally-spaced joists which have end hooks releasably hooked onto said transverse frame, with a pair of joists protruding away from said transverse frame, the spacing between the joists of each pair being adjustable, said hooks engaging said transverse frame with a play to allow limited longitudinal movement of said joists relative to said transverse frame.

* * * * *